US005432962A

United States Patent [19]

Huang

[11] Patent Number: 5,432,962

[45] Date of Patent: Jul. 18, 1995

[54] ADJUSTING MEANS FOR A RAILING SIDE OF A CHILD'S COT

[76] Inventor: Cheng-Kuei Huang, No. 189, Sec. 3, Chungshan Rd., Wujih Hsiang, Taichung Hsien, Taiwan

[21] Appl. No.: 230,257

[22] Filed: Apr. 20, 1994

[51] Int. Cl.[6] ..... A47D 7/10

[52] U.S. Cl. ..... 5/100; 5/428; 292/124; 292/170

[58] Field of Search ..... 5/100, 428; 292/111, 292/114, 124, 170, 174

[56] References Cited

U.S. PATENT DOCUMENTS

| | | | |
|---|---|---|---|
| 1,413,979 | 4/1922 | Freund | 292/170 |
| 2,726,889 | 12/1955 | Lawson | 292/337 X |
| 3,830,535 | 8/1974 | Read et al. | 292/170 |
| 4,226,452 | 10/1980 | Hoffman | 5/100 X |
| 4,703,524 | 11/1987 | Brunner et al. | 5/100 X |
| 4,768,243 | 9/1988 | Waples | 5/100 |
| 5,068,932 | 12/1991 | Chang | 5/100 |
| 5,072,464 | 12/1991 | Draheim et al. | 5/100 X |
| 5,146,632 | 9/1992 | Li | 5/100 |

*Primary Examiner*—Michael F. Trettel

*Attorney, Agent, or Firm*—Sixbey, Friedman, Leedom & Ferguson

[57] ABSTRACT

An adjustable means for a railing side of a child's cot, includes at least four strips each fixed on a post of the cot, at least two holes and two openings are defined in each strip. An adjusting element comprises a vertical part and a horizontal part in which an activating element, a connecting element and a spring are received therein. The connecting element has a first end having a connecting hook disposed thereon which engages to the opening of the strip, and a second end has a recess defined therein for connecting one end of the spring, and a tunnel is defined in the connecting element vertically. The activating element has a base on which a projection with a hook part formed thereon and a block with a bevel surface are projecting therefrom and are received in the tunnel, the hook part is engaged to a periphery defining the tunnel.

3 Claims, 4 Drawing Sheets

ADJUSTING MEANS FOR A RAILING SIDE OF A CHILD'S COT

BACKGROUND OF THE INVENTION

The present invention relates to an adjusting means and, more particularly, to an improved adjusting means for a railing side of a child's cot.

A child's cot usually comprises a frame with four wheels disposed on an under side thereof, four posts, four railing sides and a base, each railing side connects to two respective posts and thus encloses a rectangular area in which the base is disposed therein. The railing side is adjusted by an adjusting means disposed on an end of the railing side, however, the current use adjusting means is difficult to operate.

The present invention intends to provide an improved adjusting means to mitigate and/or obviate the above-mentioned problems.

SUMMARY OF THE INVENTION

The present invention provides an adjustable means for a railing side of a child's cot, and includes at least four strips each fixed on a post of the cot, at least two holes and two openings are defined in the strip. An adjusting element comprises a vertical part and a horizontal part in which an activating element, a connecting element and a spring are received therein. The connecting element has a first end having a connecting hook disposed thereon which engages to the opening of the strip, and a second end has a recess defined therein for connecting one end of the spring, and a tunnel is defined in the connecting element vertically. The activating element has a base on which a projection with a hook part formed thereon and a block with a bevel surface are projecting therefrom and are received in the tunnel, the hook part is engaged to a periphery defining the tunnel.

It is an object of the present invention to provide an adjusting element which is disposed between a railing side and a strip and is disengaged from the strip only by a single movement of the adjusting element.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
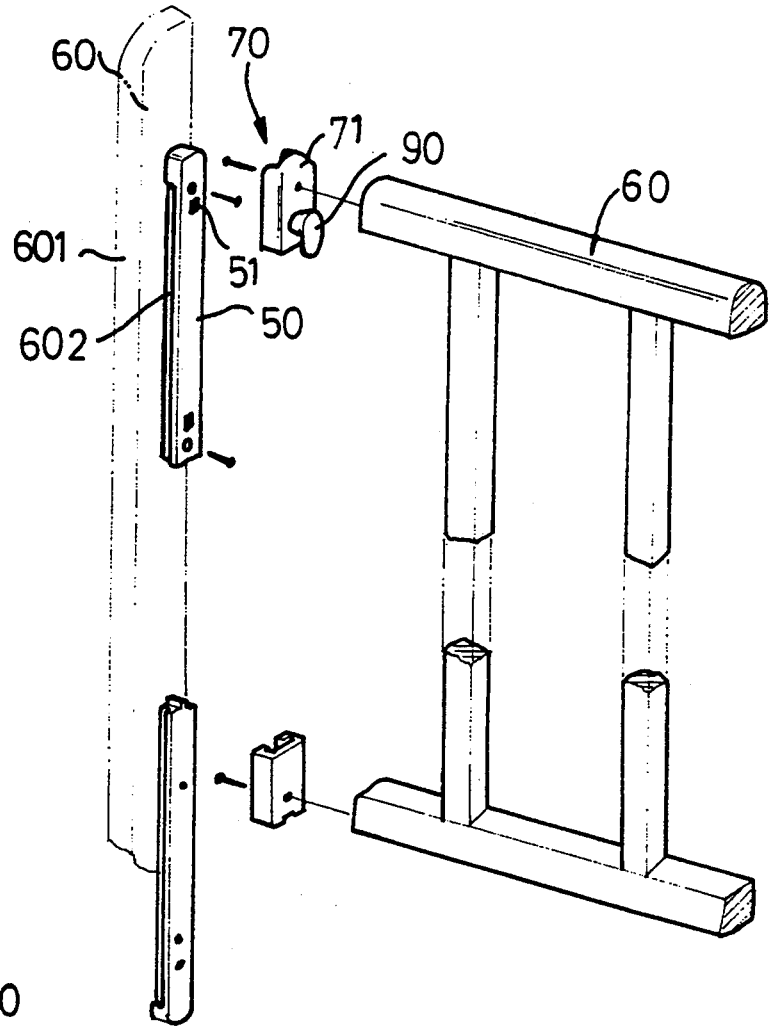
FIG. 1 PRIOR ART
FIG. 1 is an exploded view of a conventional adjusting means for a railing side of a child's cot.
Figure 2:
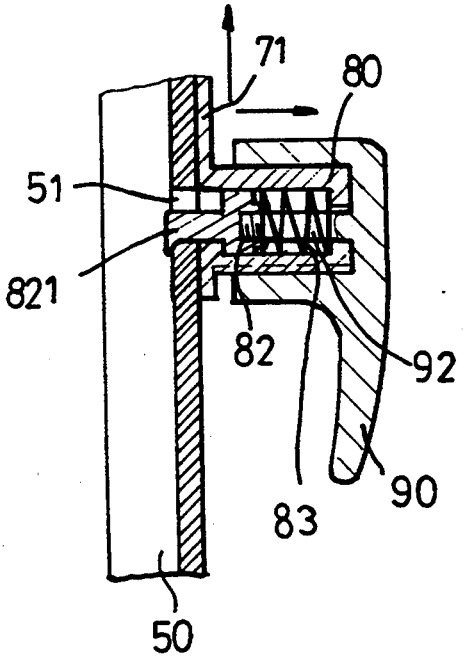
FIG. 2 PRIOR ART
FIG. 2 is a side elevational view, partly in section, of the conventional adjusting means.

Referring to FIGS. 1 and 2, a railing side 60, a post 601 and a conventional adjusting means which comprises a strip 50 and an adjusting element 70 are shown. The strip 50 having at least two openings 51, defined by four edges, is fixedly engaged to the post 601 in which two grooves 602 are defined in two sides thereof, a recess (figure not shown) is accessible to the opening 51. The adjusting element 70 is fixedly engaged to one end of the railing side 60 by bolts, and has two rails formed on opposite sides thereof for slidable engagement to the grooves 602. A hollow cylindrical part 80 projects from the adjusting element 70 and a first hole is defined therein and accesses to the opening 51, a second hole is defined in a top surface of the cylindrical part 80. A knob 90 has a recess defined therein and a threaded central rod 92 projects from an inner side thereof within the recess. The knob 90 is mounted on the cylindrical part 80 and a spring 83 is mounted on the central rod 92 which is threadedly engaged to a hook element 82 via a recess defined therein. The hook element 82 has a hook 821 engaging to the rim of the opening 51 of the strip 50.

When adjusting the railing side 60 by operating the adjusting element 70, a user is required to hold the knob 90 and lift it up to raise the hook 821 and then pull the knob 90 to let the hook 821 disengage from the opening 51, and then he can move the railing side 60 and insert it into another opening 51. In the operation mentioned above, the user needs to operate two actions in different directions which cannot satisfactorily fill the needs of quickness and convenience.

Figure 3:
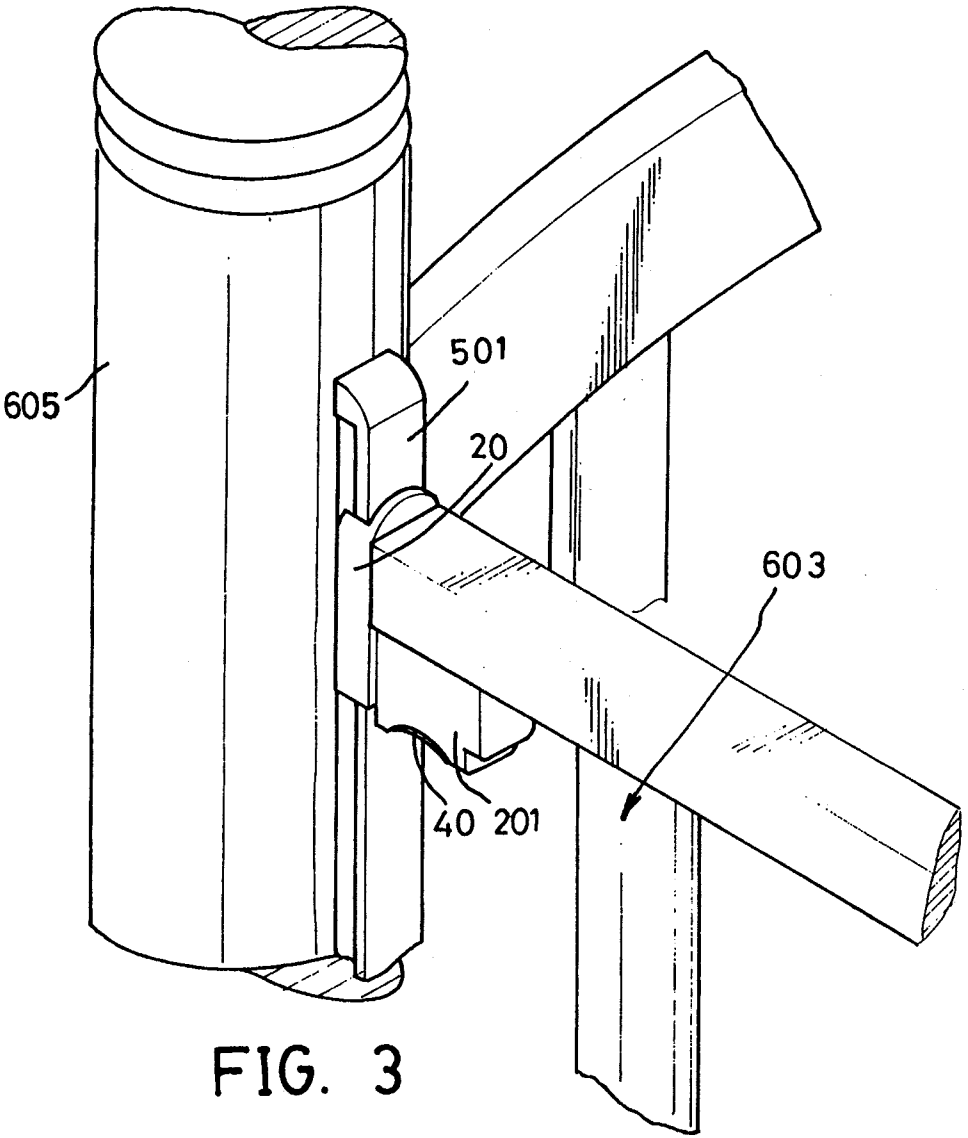
FIG. 3 is a perspective view of a child's cot utilizing an adjusting means in accordance with the present invention.
Figure 4:
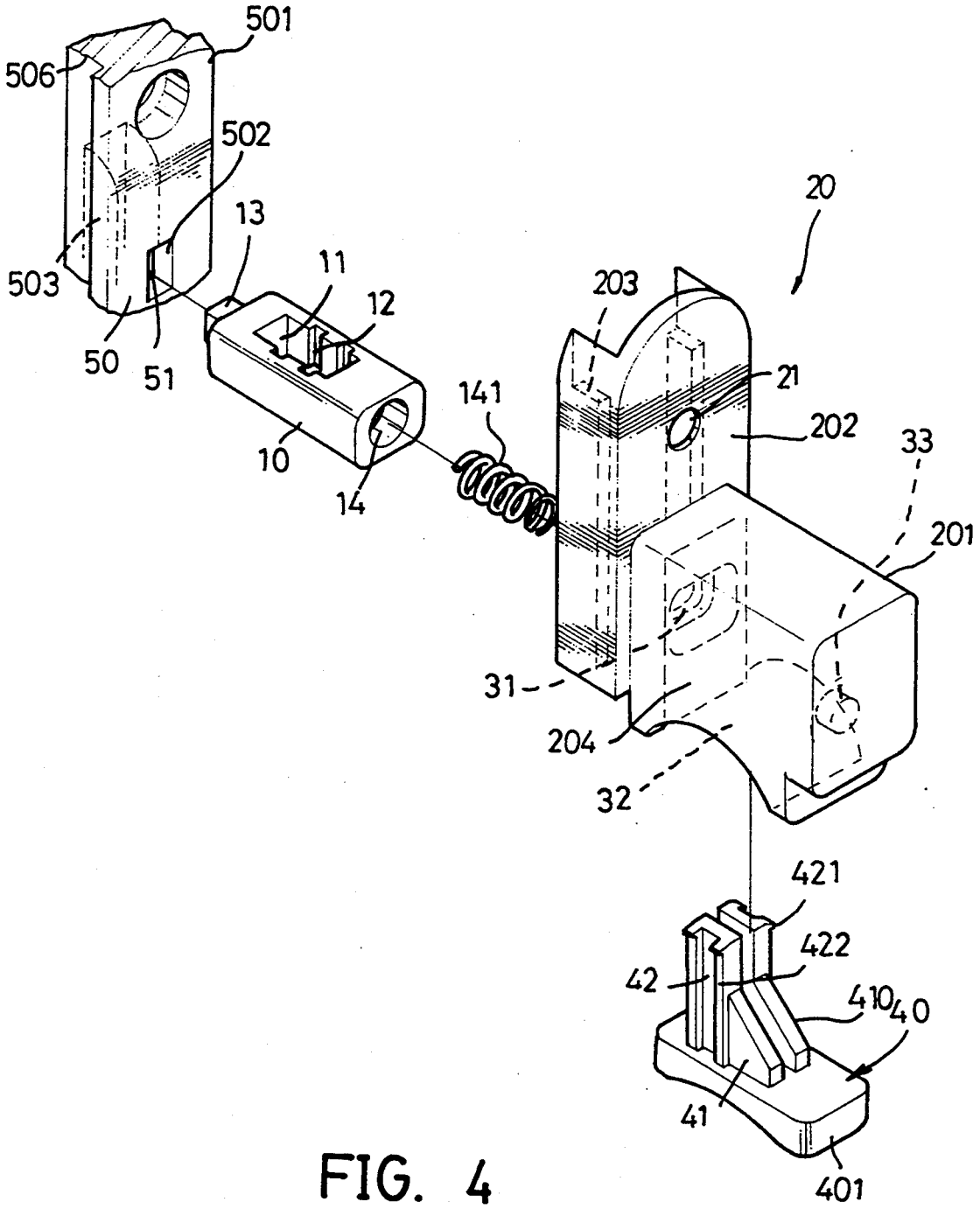
FIG. 4 is an exploded view of the adjusting means for a railing side of a child's cot in accordance with the present invention.
Figure 5:
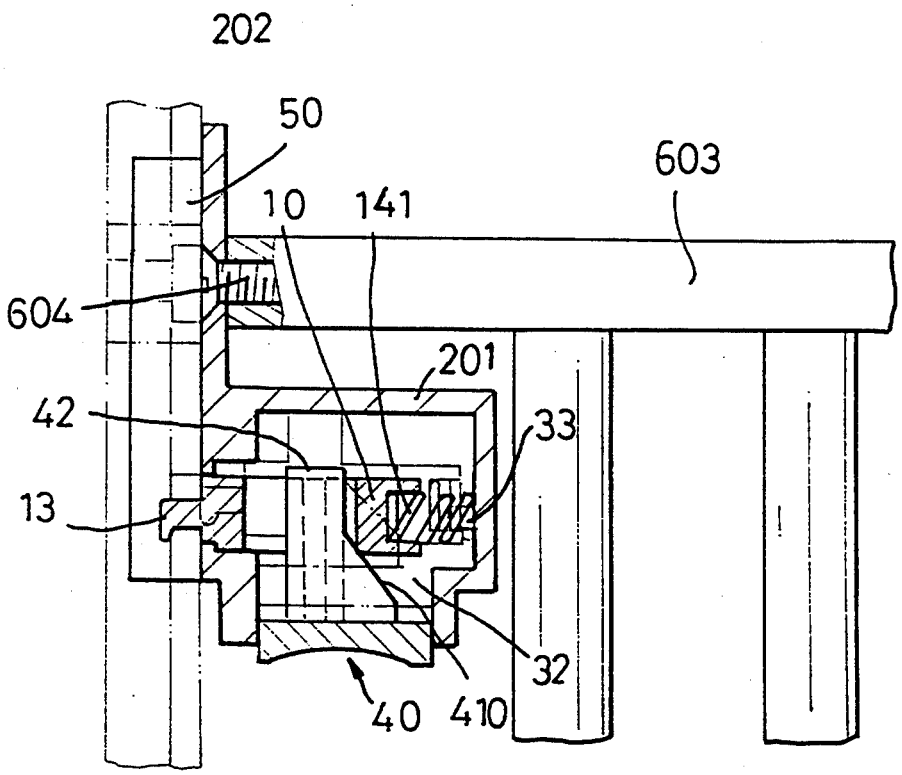
FIG. 5 is a side elevational view, partly in section, of the adjusting means connecting to the railing side and the movement of the adjusting element is shown in phantom lines.

Referring to FIGS. 3–5, the adjusting means in accordance with the present invention includes an adjusting element 20 engaged to one end of a railing side 603 and a strip 501 engaged to a post 605. The strip 501 has at least two openings 502 defined by four rims in an inner side thereof and a recess 503 is defined in an outer side of the strip 501 and is accessible to the opening 502. A groove 506 is defined in two opposite sides of the strip 501. The adjusting element 20 has a main body including a horizontal part 201 having first and second ends and a vertical part 202 which has two extending rails 203 for slidable engagement with the grooves 506 and is fixedly engaged to one end of the railing side 603 by a bolt 604 threading therethrough via a hole 21 defined in the vertical part 202. The horizontal part 201 has a recess 204 defined therein and an opening 32 is defined in an under side thereof and which is accessible to the recess 204. A connecting element 10 and an activating element 40 are respectively received in the recess 204 via a through hole 31 defined in the vertical part 202 and communicating to the recess 204 of the horizontal part 201 and the opening 32 respectively. A fixing means, a stud 33 for example, is disposed in an inner side of the second end of the horizontal part 201.

The activating element 40 has a base 401 sized to be able to be inserted in the recess 32 via the opening 32, a projection comprising two plates 42, with a gap existing therebetween, projects from an upper surface of the base 401, each plate 42 has two flanges 422 projecting from a side thereof, and each plate 42 has a hook part 421 formed on a top portion thereof. A block 41 is disposed on the base 401 and abuts the plate 42, the block 41 has a bevel surface 410 with a downward slope in a direction from the first end of the horizontal part 201 to the second end thereof.

The connecting element 10 has first and second ends, a connecting hook 13 is disposed on the first end thereof for engagement to the periphery of the opening 502 of the strip 501 and a recess 14 is defined in the second end thereof for receiving one end of a spring 141 whose the other end is engaged to the stud 33 of the horizontal part 201. A tunnel 11 is defined vertically by four inner surfaces in the connecting element 10 through which the plates 42 pass, and two grooves 12 are defined in the opposite inner surfaces for the flanges 422 of the plates 42 to engage therein. The hook parts 421 hook on an edge rim abutting the tunnel 11 of the connecting element 10.

When adjusting the railing side 603, a user holds the activating element 40 and lifts both the activating element 40 and the railing side 603 up, the connecting hook 13 is then raised. Simultaneously, the connecting element 10 is moved towards to the vertical part 202 to push the spring 141 by an action of the bevel surface 410 of the block 41 exerting a force in a horizontal direction to an edge of the inner surface of the tunnel 11 near the second end of the connecting element 10, thus, the connecting hook 13 is disengaged from the opening 502. Thereby, the railing side 603 and the adjusting element 20 can be moved and the connecting hook 13 can be inserted into another opening 502 of the strip 501 so as to achieve an object of adjustment of the railing side 603 by a single action.

Although the invention has been explained in relation to its preferred embodiment, it is to be understood that many other possible modifications and variations can be made without departing from the spirit and scope of the invention as hereinafter claimed.

I claim:

1. An adjustable means for a railing side of a child's cot, said cot comprising:

four posts; and four railing sides each having two ends and connected between two posts;

said adjustable means comprising:

at least four strips one said strip fixed on each of said four posts of said cot and having at least two holes and two openings defined therein, said opening communicating to a recess defined in an outer side of said strip;

an adjustable element having a main body, an activating element and a connecting element, said main body including a vertical part and a horizontal part, said vertical part having a hole defined therein for connecting to an end of said railing side, said horizontal part having first and second ends, a recess defined therein and accessing to an opening defined in an under side thereof, a hole being defined through said first end of said horizontal end and said vertical part and a fixing means being disposed in an inner side of said second end of said horizontal part;

said activating element having a base sized to be inserted in said recess via said opening, a projection projecting from an upper surface of said base and having at least one hook part formed on an top portion of said projection and a block being disposed abutting said projection, said block having a bevel surface sloping downward in a direction from said first end of said horizontal part to said second end thereof; and said connecting element having first and second ends, a connecting hook being disposed on said first end thereof for engaging to a periphery defining one of said openings of said strip and a recess being defined in said second end thereof, a tunnel being defined vertically by four inner surfaces in said connecting element and for said projection of said activation element passing through and said hook part hooking on an edge of one of said inner surface, and a spring being disposed between said recess of said connecting element and said fixing means of said horizontal part.

2. The adjustable means as claimed in claim 1 wherein said projection of said activating element comprises two spaced plates disposed opposite each having two flanges projecting from an outer side thereof and, two grooves being defined in two of said inner surfaces corresponding to said flanges for engagement thereby.

3. The adjustable means as claimed in claim 1 wherein said fixing means of said horizontal part of said activating element is a stud.

* * * * *